United States Patent [19]

Fornasari

[11] Patent Number: 4,753,271

[45] Date of Patent: Jun. 28, 1988

[54] FOUR-WAY ELECTROVALVE GOVERNED BY A THERMOACTUATOR ASSOCIATED WITH A THERMISTOR (PTC)

[75] Inventor: Paolo Fornasari, Casale Monferrato, Italy

[73] Assignee: Eltek, S.p.A., Casale Monferrato, Italy

[21] Appl. No.: 48,254

[22] Filed: May 11, 1987

[30] Foreign Application Priority Data

May 30, 1986 [IT] Italy ..... 67446 A/86

[51] Int. Cl.[4] ..... F16K 31/68

[52] U.S. Cl. ..... 137/625.43; 137/625.44; 251/11; 251/335.3

[58] Field of Search ..... 137/625.43, 625.44, 137/874, 875; 62/324.6; 251/11, 335.3

[56] References Cited

U.S. PATENT DOCUMENTS 4,618,092 10/1986 Fukushima et al. ..... 251/335.3 X

FOREIGN PATENT DOCUMENTS 36662 3/1980 Japan ..... 251/11

151676 8/1984 Japan ..... 137/625.43

*Primary Examiner*—Gerald A. Michalsky

*Attorney, Agent, or Firm*—Browdy and Neimark

[57] ABSTRACT

A four-way electrovalve, particularly for the reversal of refrigerant flow in all types of refrigeration and conditioning systems such as heat pumps, or any other systems where it is periodically necessary to reverse the direction of flow of a compressed fluid. The valve comprises a hermetically sealed housing with four ports for the inflow and outflow of pressurized fluids; said ports are controlled by a deflector governed by a thermoactuator associated with one or more thermistors (PTC) acting against elastic devices (FIG. 1.).

7 Claims, 1 Drawing Sheet

X
X
$C_m$
$C_o$
$C_p$
$E_v$
$V_4$

FOUR-WAY ELECTROVALVE GOVERNED BY A THERMOACTUATOR ASSOCIATED WITH A THERMISTOR (PTC)

DESCRIPTION

Refrigeration devices, both industrial and domestic, use solenoid valves whose electromagnet controls the flow of the refrigerant. Said valves are also widely used in heat pumps, and all other applications where it is necessary to periodically reverse the direction of flow of a pressurized liquid.

With regard to the present invention, the use of said valves in refrigeration systems has the purpose of reversing the cycle of pressurized liquids which generally flow from the compressor to the condenser, and then to an evaporator. The electromagnets currently used for this purpose are complex, costly, and have a number of functional drawbacks.

The present invention is a four-way electrovalve with a simple mechanical structure that is reliable, economically advantageous to manufacture, and able to perform all the functions of the previously mentioned solenoid valves in refrigeration and other systems.

The applicant also holds other Italian patents, application No. 53024 B/85 filed Feb. 22, 1986 and application No. 52873 B/85 filed on Jan. 21, 1985, that include thermoactuating devices comprising a casing enclosing a waxy, highly thermally expandable mass associated with a mobile plunger partially immersed in said casing and one or more thermistors (PTC) acting as controlled heat sources.

The present invention is a valve comprising a housing with four inflow and outflow ports controlled by a deflector that can move in an angular fashion against the reaction of elastic devices; it is actuated by a mobile plunger part of a thermoactuator described in the previously mentioned patents.

The invention will be described further, by way of example, with reference to the accompanying drawings in which.

Figures 1, 2, 3, 4, 5, 6:
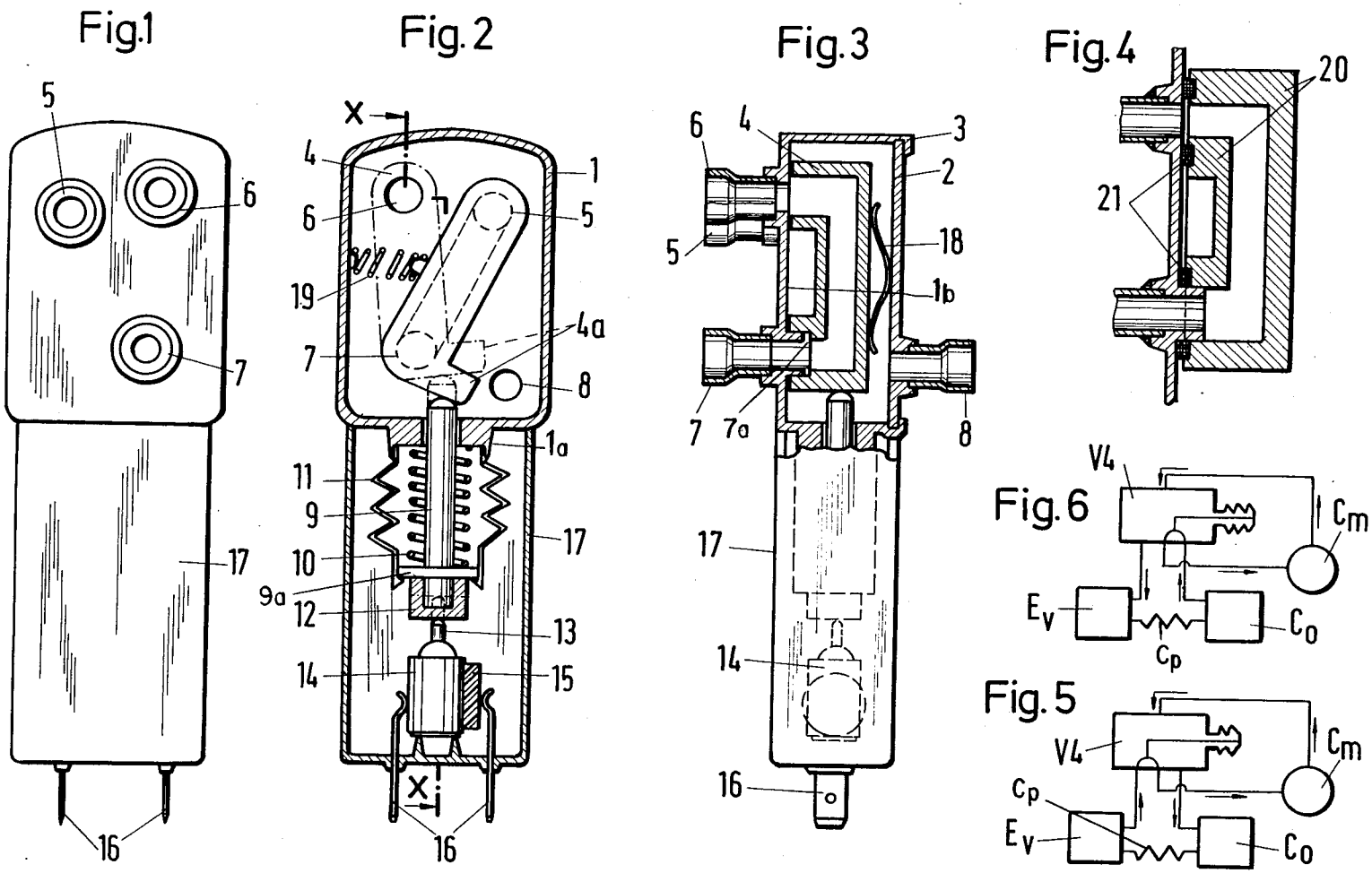
FIG. 1 is a front view of the valve illustrating the preferred type of actuation.
FIG. 2 is a vertical cross section of the same valve shown in FIG. 1 turned 180° on a vertical axis.
FIG. 3 is a vertical cross section along line X—X in FIG. 2 and turned 90° on a vertical axis with respect to FIGS. 1 and 2.
FIG. 4 is a vertical cross section showing a variation in the structure of the deflector.

FIGS. 5 and 6 schematically illustrate the two opposite flow cycles of the refrigerant controlled by the valve.

With reference to the figures, housing 1 encloses deflector 4 and integral projection 4*a*, which are hinged at the inner tip 7*a* of port 7; said deflector is held in the angular position shown by the solid line in FIG. 2 against the inner surface 1*b* of housing 1 by the reaction of coil spring 19 and by leaf spring 18. In addition to port 7, the front of housing 1 also has ports 5 and 6 and is closed at the back by welded cover 2, which includes port 8. One end of metal bellows 11 is welded at the neck of housing 1; the other end of said bellows is welded or hermetically crimped to the base 9*a* of rod 9, which is mounted vertically inside said bellows 11. A spring 10 exerts pressure between said base 9*a* of rod 9 and neck 1*a*. A bushing 12, made of electrically insulating material such as ceramic, is mounted coaxially with rod 9 outside the bellows. The free end of a plunger 13 whose opposite end is hermetically sealed in a casing 14 enclosing a wax having high thermal dilative properties rests on the closed bottom of said bushing. A thermistor (PTC) 15 is associated with casing 14; 16 indicates electrical terminals for supplying power to the thermistor(s) 15. 17 indicates the valve mechanism housing, which is preferably made of thermoplastic material, and contains the valve's thermoelectric actuator. Valve housing part (1) may be made, for example of metal.

The valve operates as follows:

Given that port 8 is connected to a refrigerant liquid supply line, when the valve is in the resting position, meaning deflector 4 is positioned as shown in FIG. 2 by the solid lines, the liquid flowing into port 8 enters housing 1 and exits through port 6; during the return stage, said liquid enters port 7, passes through deflector 4, and exits at port 5.

When terminals 16 are supplied with electric power thermistor 15 increases in temperature, which by conduction heats casing 14 and the wax contained in it; said wax expands forcing plunger 13 to move outwards; said movement is transmitted to rod 9, which overcomes the pressure exerted by spring 10. The end of rod 9 rests against the angled tip of deflector 4 causing said deflector to move in an angular fashion at hinge 7*a* of port 7. Spring 19 is compressed and deflector 4 moves into the position shown by the dashed lines in FIG. 2. Under these latter conditions, the cycle is reversed for the fluid that had entered at port 8. The fluid can only flow out through port 5, and then re-enter at port 7 exiting at port 6.

When power is no longer supplied to thermistor 15 the reaction of springs 10 and 19 force the mobile valve elements back to their initial position. Metal bellows 11 is hermetically sealed at neck 1*a* and base 9*a*; therefore, no matter which refrigerant cycle (lines connected to ports 5, 6, 7, 8, and valve housing 1) is operative there is no leakage of fluid.

With reference to FIGS. 5 and 6 where the essential components of a fluid refrigerant cycle are schematically illustrated, (FIG. 5) compressor —$C_m$— sends the fluid to housing 1 of the present valve V4; the fluid enters at port 8 and passes through deflector 4, which is in the position shown by the solid lines in FIG. 1, and then arrives at condenser —$C_o$—: said fluid passes through the capillary tubing —$C_p$— reaching evaporator —$E_v$—; the liquid is then sent to port 6 from the evaporator thus re-entering the closed cycle.

When the internal temperature of the refrigeration system reaches a preset level, a sensor such as a thermostat closes the circuit that electrically powers terminals 16 (FIG. 1) of the valve causing deflector 4 to move into the position indicated by the dashed lines in FIG. 1 and shown schematically in FIG. 6. Under these conditions the fluid cycle is reversed as previously described and indicated by the arrows in FIG. 6 with respect to FIG. 5.

FIG. 4 illustrates a variant of the present valve where 20 is a deflector similar to that indicated by 4 in FIGS. 1–3, but different from the latter which is made of plastic; deflector 20 is made of metal. In this case said deflector 20 has seals 21 at its edges to provide a hermetic seal with respect to surfaces 1*b* of housing 1.

The present valve has a simple design, is functionally reliable, and lowers operative costs. The valve can be used for numerous applications in addition to those described for refrigeration systems.

I claim:

1. A four-way electrovalve comprising:

a two-part (1,17), box-shaped housing, one of the two parts (1) including a deflector (4) rotatable on an internally projecting hinge (7a) of a port (7); said one part of said housing having an additional two ports (5,6) controlled by the variable angular position of said deflector (4) against the reaction of elastic devices (18,19); a fourth inlet port (8) located within said one part of said housing at a position not controllable by the deflector (4);

said one part of said housing (1) having a neck (1a) hermetically connected to one end of a bellows (11), the opposite end of said bellows being hermetically connected to the base (9a) of a rod (9) mounted coaxially with respect to said one part of said housing (1), said bellows enclosing a portion of said rod extending from said base to said hermetic connection at said neck (1a); said rod being inside a spring (10);

electrical insulating means (12) axially aligned with the base (9a) of said (9) in contact with a plunger, said plunger (13) extending from a casing (14) containing a material having high thermal dilative properties, said plunger being partially immersed in the casing;

the other part of said housing (17) having said casing therein, said casing contacting a thermistor (15) with electrical terminals (14) projecting from the other part of said housing (17).

2. An electrovalve as claimed in claim 1, in which the deflector (4) is mounted so that it can rotate with respect to an internal projection (7a) of one of the valve's ports.

3. An electrovalve as claimed in claim 1, in which the deflector (4) lacks seals.

4. An electrovalve as claimed in claim 1, in which a variant of the valve (FIG. 4) comprises a metal deflector that includes frontal seals.

5. An electrovalve as claimed in claim 1, in which said one part of said housing is made of metal (1) and the other part (17) of said housing is connected to and removable from the first part.

6. An electrovalve as claimed in claim 1, in which a thermoactuator transmits angular movement to the valve's deflector; said deflector includes an angled projection (4a).

7. An electrovalve as claimed in claim 6 in which said thermoactuator comprises said thermistor as a controlled heat source.

* * * * *